US005259310A

United States Patent [19]

Fischer

[11] Patent Number: 5,259,310

[45] Date of Patent: Nov. 9, 1993

[54] CIRCUMFERENTIAL REGISTER ADJUSTING ASSEMBLY

[75] Inventor: Christian M. M. Fischer, Marktheidenfeld, Fed. Rep. of Germany

[73] Assignee: Koenig & Bauer Aktiengesellschaft, Wurzburg, Fed. Rep. of Germany

[21] Appl. No.: 961,650

[22] Filed: Oct. 16, 1992

[30] Foreign Application Priority Data

Oct. 19, 1991 [DE] Fed. Rep. of Germany ..... 4134571
Nov. 29, 1991 [DE] Fed. Rep. of Germany ..... 4139326

[51] Int. Cl.[5] ..... B41F 13/14; B41L 35/06
[52] U.S. Cl. ..... 101/248
[58] Field of Search ..... 101/248, 181, 247; 384/267, 266, 264, 263, 271; 74/439, 440, 444

[56] References Cited

U.S. PATENT DOCUMENTS

| | | | |
|---|---|---|---|
| 2,147,883 | 2/1939 | Conner | 384/267 |
| 2,775,935 | 1/1957 | Reinartz et al. | 101/248 |
| 3,791,294 | 2/1974 | Skelding | 101/248 |
| 4,572,074 | 2/1986 | Guaraldi | 101/248 |

FOREIGN PATENT DOCUMENTS

| | | |
|---|---|---|
| 0405249 | 6/1989 | European Pat. Off. . |
| 3918128 | 6/1989 | Fed. Rep. of Germany . |

*Primary Examiner*—J. Reed Fisher
*Attorney, Agent, or Firm*—Jones, Tullar & Cooper

[57] ABSTRACT

A circumferential register adjusting assembly utilizes concentric inner and outer bushings which overlie an axle journal of a plate cylinder. Axial movement of the outer bushing is converted into rotational movement of the inner bushing and of the plate cylinder. A centrally pivoted two arm lever is used to accomplish the axial movement of the outer bushing.

7 Claims, 1 Drawing Sheet

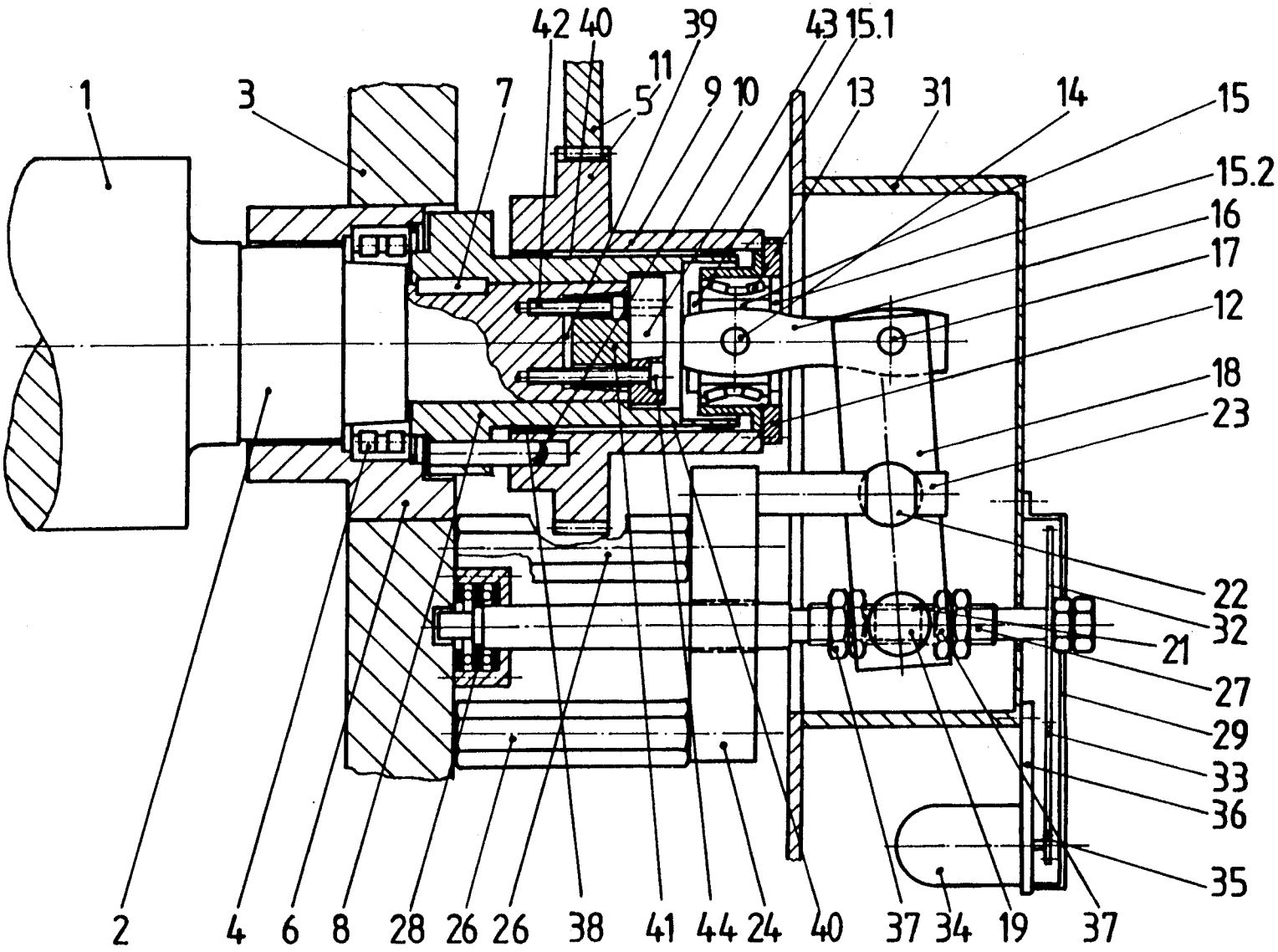
15
15.2
16
17
12
18
23
22
32
21
27
29
33
36
35
37
14
19
31
34
37
13
15.1
43
40
24
10
9
44
39
41
11
5
40
38
42
26
7
26
28
8
6
3
4
2
1

CIRCUMFERENTIAL REGISTER ADJUSTING ASSEMBLY

FIELD OF THE INVENTION

The present invention is directed generally to a circumferential register adjusting assembly. More particularly, the present invention is directed to a circumferential register adjusting assembly for a rotary printing press. Most specifically, the present invention is directed to a device for adjusting the circumferential register in a rotary printing press by means of an axially movable adjusting drive. This axially movable drive causes an outer bushing to slide axially and to rotate. The rotation of this outer bushing is transferred to an inner bushing which also rotates. The inner bushing, in turn, causes the cylinder, whose circumferential register is to be adjusted, to rotate. An insert in the cylinder axle journal is utilized to radially expand the inner bushing toward the outer bushing so that play between the inner and outer bushings is reduced.

DESCRIPTION OF THE PRIOR ART

In rotary printing presses it is necessary to adjust the circumferential register of plate carrying cylinders to insure that the products printed by the printing plates do not have registration errors. One generally known procedure which is used to adjust the circumferential register of the plate cylinders is to utilize helically toothed gear wheels in the drive train of the plate cylinder.

One device which is usable to adjust the circumferential register of a plate cylinder is shown in European Letters Patent No. 04 05 249 A2. In this device, an adjusting shaft is seated in a roller bearing with an eccentric bushing. A sleeve which is seated in a second roller bearing is located on the eccentric bushing and is securely connected with a helically toothed drive wheel. The adjusting shaft, which is threaded, is axially displaced by being rotated through use of a suitable drive motor. As the adjusting shaft is displaced axially, its axial movement is transferred by the eccentric bushing and sleeve to the toothed drive wheel. Since this toothed drive wheel has helical teeth, its axial displacement causes it to also rotate slightly. This rotation, in turn, changes the circumferential position of the plate cylinder to which the toothed gear wheel is connected. The circumferential register of the plate cylinder is thus changed by axial movement of the adjusting shaft.

In this prior art device, the eccentric bushing that is provided with the two roller bearings and that is carried by the axially displaceable adjusting shaft is connected to the second eccentric bushing in the frame of the press by means of a bar linkage. This dual eccentric arrangement, which utilizes a plurality of ball bearings results in a relatively large amount of bearing play. This substantial bearing play, in turn, has a negative or limiting effect on the accuracy of the register adjustment that can be accomplished using this prior art device.

Another device that is used for adjusting the page and circumferential register in a rotary printing press is shown in German published, unexamined patent application No. DE-OS 3918 128. In this prior art device the register adjustment is accomplished by the axial displacement and turning of a cylinder in a rotary printing press. This axial displacement and turning is done through the use of a helically-geared drive wheel train.

This drive train in this prior art device requires a plurality of quite expensive precision toothed gear wheels.

It will thus be apparent that a need exists for an apparatus for adjusting circumferential register in a manner which avoids the limitations of the prior art device. The circumferential register adjusting assembly of the present invention provides such a device and is a significant advance over the prior art.

SUMMARY OF THE INVENTION

It is an object of the present invention to provide a circumferential register adjusting assembly.

Another object of the present invention is to provide a circumferential register adjusting assembly for a rotary press.

A further object of the present invention is to provide a device for adjusting the circumferential register by means of an axially movable adjusting drive.

Yet another object of the present invention is to provide a circumferential register adjusting assembly in which a pivotal or rotational movement for starting or stopping the plate cylinder which carries the image to be printed is possible in spite of the fact that the adjusting means for accomplishing the circumferential register adjustment is fixed in place.

As will be discussed in detail in the description of the preferred embodiment which is set forth subsequently, the circumferential register adjusting assembly of the present invention utilizes an inner bushing which is keyed to the axle journal of the plate cylinder, and an outer bushing which is connected to the inner bushing. The outer bushing carries a helically splined gear which meshes with the press gear drive. As the outer bushing is shifted axially by an axially movable coupler, it is caused to rotate. This rotation of the outer bushing causes a corresponding rotation of the inner bushing and hence an adjustment of the circumferential register of the plate cylinder. The axial movement of the coupler is accomplished by the movement of a centrally pivoted two armed lever, a first end of which engages the coupler and a second, forked portion end of which is connected to an axially movable threaded spindle. This threaded spindle is rotatably supported by the side frame of the press and is driven by a drive motor.

A particular advantage of the circumferential register adjusting assembly of the present invention lies in its ability to allow a continuous adjustment of the circumferential register of a plate cylinder of a rotary printing press to be accomplished while utilizing technically uncomplicated means even though the plate cylinder is making a pivotal or rotational movement. The present invention avoids the substantial bearing play which has been present in prior art devices through the use of a tapered insert that is usable to expand a shell portion of the printing cylinder's axle journal. Since this radial bearing play is substantially eliminated, a precise adjustment of the circumferential register of the plate cylinder is assured.

The circumferential register adjusting assembly of the present invention overcomes the limitations of the prior art devices and is a substantial advance in the art.

BRIEF DESCRIPTION OF THE DRAWINGS

While the novel features of the circumferential register adjusting assembly in accordance with the present invention are set forth with particularity in the appended claims, a full and complete understanding of the invention may be had by referring to the detailed description of the preferred embodiment which is presented subsequently, and as illustrated in the accompanying sole drawing figure which is a cross-sectional view through a preferred embodiment of a circumferential register adjusting assembly in accordance with the present invention.

DESCRIPTION OF THE PREFERRED EMBODIMENT

Referring now to the sole drawing there may be seen a preferred embodiment of a circumferential register adjusting assembly in accordance with the present invention. A portion of a plate cylinder, generally at 1 is depicted in the sole drawing fiqure. It will be understood that plate cylinder 1 will carry one or more printing plates on its surface and will cooperate with a rubber blanket cylinder, not shown, as well as an ink applicator roller of an offset printing press which is also not shown in the drawing. These portions of the rotary printing press are generally conventional in nature and form no part of the present invention.

Plate cylinder 1 has an elongated axle journal 2 which is rotatably supported by a tapered roller bearing 4. This roller bearing 4 is, in turn, enclosed in an eccentric bushing 6 which is fastened in a side wall 3 of the rotary press frame. A first, inner bushing 8 is joined to an outboard end of the axle journal 2 by means of at least one feather key 7 or other similar fastening means. This inner bushing 8 is generally cylindrical and surrounds the axially outer end of the axle journal 2. A second, outer bushing 9 is concentric with, and surrounds the inner bushing 8. The two bushings 8 and 9 are connected together so that there is no relative rotational movement between them. This is accomplished by using one or more drive pins such as a rotary driver 10 which can be a bolt. The two bushings 8 and 9 can move axially with respect to each other. A helically splined drive wheel 11 is formed on the outer peripheral surface of the second, outer bushing 9. This helically toothed drive wheel meshes with a complimentary helically toothed or splined drive gear 5 which is part of the drive of the plate cylinder 1.

As may be seen in the sole drawing figure, an end face of the outer bushing 9 which is most remote from the plate cylinder 1 is connected through a ring 12 with an outer ring or race of a roller bearing assembly 13. This roller bearing 13 can be embodied as a self-aligning bearing. An inner ring or race of the bearing 13 is coupled or connected with a linking point 14 of an axially shiftable coupler 16. This linking point 14 can be embodied as a gimbal-mounted tapered roller bearing. This roller bearing assembly 13 also includes a coupler bushing 15 which is interposed between the inner race of bearing 13 and the surface of an inner end of the coupler 16 generally in the area of link point 14. The bushing 15 includes an inner collar 15.1 on the end of bushing 15 closer to the journal axle 2 and a threaded end which will receive a threaded nut 15.2. The use of the threaded nut 15.2 on the threaded portion of the coupler bushing 15 secures the coupler bushing 15 in place in engagement with the roller bearing 13. The bushing 15 also has a gimbal-mounted linking point 14 which may be in the form of a bolt.

An axially outer end of the coupler 16; i.e. an end further away from the axle journal 2, is pivotably connected by means of a linking point 17 with an upper end portion of a two-armed lever 18. Both the upper end portion of the two armed lever 18 and a corresponding lower end portion can be fork-shaped. The lower, fork-shaped end of the two arm lever 18 carries a transversely extending bolt 19 which extends between the two spaced tines of the fork-shaped lower end of the two armed lever 18. This transverse bolt 19 has a threaded bore 21 which is generally perpendicular to the longitudinal axis of bolt 19 and which is preferably positioned equidistant between the two spaced tines of the fork-shaped lower end portion of two armed lever 18.

Generally at its midpoint, the two armed lever 18 is pivotably supported by a pivot seating point 22. This pivot seating point 22 is generally in the form of a shaft. This seating point or shaft 22 is supported on a support 23 which is attached at its inner end to a support plate 24. This support plate 24 has at least three support bolts 26 which are connected to the side wall 3 of the printing press. This seating point 22 for the two armed lever 18 is securely supported by the press frame 3.

A threaded spindle 27 is supported in the threaded bore 21 of the bolt 19 that is carried between the two spaced tines of the lower, fork-shaped end of the two armed lever 18. This threaded spindle 28 has its longitudinal axis generally parallel to the longitudinal axis of the axle journal 2. An inner end of the threaded spindle 27 is supported in a bearing 28 which is attached to the side wall 3 of the press. The axially shiftable coupler 16, the two-armed lever 18, and the threaded spindle 27 are located within a housing 31 with a lower portion of the housing having a cover 29. An outer end of the threaded spindle 27 is rotatably supported by this cover 29. A toothed ring or sprocket 32 is secured to the outer end of the threaded spindle 27 within the cover 29. A drive chain 33 passes around the toothed ring or sprocket 33 and also around a toothed ring 35 or drive sprocket that is secured on a shaft of drive motor 34. The drive motor 34 is fastened to the cover 29 by way of its base plate 36. The threaded spindle 27 is provided with adjustable stops 37 on either side of the transverse bolt 19 to limit its range of adjustment.

As the motor 34 is operated, the drive sprocket 35 will turn. This causes the chain 33 to move the sprocket 32 and thus to cause the threaded spindle 27 to rotate. As the threaded spindle 27 turns, the transverse bolt 19 moves axially along the spindle 27, either toward or away from the side wall 3, in accordance with the direction of rotation of the spindle 27. This movement of the transverse bolt 19 causes the two armed lever 18 to pivot about its seating or pivot point 22. The result of this pivotal movement of the two armed lever 18 is an axial displacement of the coupler 16 and hence of the roller bearing 13 and the ring 12 which is attached to the bearing 13 and to the outboard end of the outer bushing 9. As the outer bushing 9 moves axially, it is caused to also rotate because of the relative axial motion between the helically splined ring 11 on the outer bushing 9 and the helically splined gear drive 5. This rotation of the outer bushing 9 results in a corresponding rotation of the inner bushing 8 because of the drive pin or pins 10 that connect the two bushings 8 and 9. Rotation of the inner bushing 8 is communicated to the axle journal 2 through the key 7 so that the axle journal 2 and hence the plate cylinder will be rotated to effect circumferential register adjustment of a printing plate supported on the surface of the plate cylinder 1.

Since the inner and outer bushings 8 and 9 must be free to shift axially with respect to each other, a certain amount of play 38 must be provided between them. This play 38 must be controlled. Too little play 38 will result in binding between the inner and outer bushings 8 and 9. Too much play will allow the outer bushing 9 to move out of concentricity with the inner bushing 8. To reduce this play 38 between the inner and outer bushings 8 and 9, the outboard end of the axle journal 2 is provided with a frustoconical bore or recess 39 which extends into the axle journal 2, and which tapers toward the plate cylinder 1. This recess 39 can receive a frustoconical expander body 41 that is held in place by a plurality of clamping screws 42. As these clamping screws 42 are tightened, the effect is to enlarge the hollow end of the axle journal 2 and to thereby radially expand the shell 40 of the inner bushing 8. This radial expansion of shell 40 decreases the amount of play between the inner and outer bushings 8 and 9. An end plate 43 is used to hold the inner bushing 8 on the axle journal 2. This end plate 43 is held on the end of the axle journal 2 by a plurality of elongated screws 44. Preferably four such screws 44 which are offset at 90° to each other are used to secure the end plate 43 to the outboard end of the axle journal 2. The clamping screws 42 which are used to expand the end of the axle journal 2 by movement of the frustoconical body or expander 41 can be accessed through holes in the end plate 43. Four such clamping screws 42 can be used and each will be spaced between two elongated screws 44.

While a preferred embodiment of a circumferential register adjusting assembly in accordance with the present invention has been set forth fully and completely hereinabove, it will be apparent to one of skill in the art that a number of changes in, for example the size of the plate cylinder, the number of printing plates carried on its periphery, the drive means for the rotary press and the like could be made without departing from the true spirit and scope of the present invention which is accordingly to be limited only by the following claims.

What is claimed is:

1. A circumferential register adjusting assembly usable to effect circumferential register adjustment of a plate cylinder in a rotary printing press, said circumferential register adjusting assembly comprising:

an axle journal extending from a plate cylinder, said axle journal being rotatably supported in a printing press;

an inner bushing fixed to an end of said axle journal for rotation with said axle journal;

an outer bushing supported on said inner bushing for rotation with said inner bushing and axially shiftable with respect to said inner bushing;

a helically splined drive wheel formed on an outer shell of said outer bushing;

means to effect axial shifting of said outer bushing and a resultant rotation of said outer bushing and said inner bushing in response to said axial shifting of said outer bushing; and means to adjust circumferential play between said inner and outer bushings, said means including a frustoconical recess in said end of said axle journal and a frustoconical body receivable in said recess and slidable therein to vary a diameter of said end of said axle journal and a diameter of said inner bushing fixed to said end of said axle journal.

2. The circumferential register adjusting assembly of claim 1 wherein said means to effect axial shifting of said outer bushing includes a coupler connected to said outer bushing and a centrally pivoted lever connected at a first end to said coupler and at a second end to a drive means.

3. The circumferential register adjusting assembly of claim 2 wherein said drive means includes a rotatable threaded spindle, connected to said second end of said lever, and a drive motor to effect rotation of said spindle.

4. The circumferential register adjusting assembly of claim 3 wherein said drive motor is connected to said rotatable spindle by a chain drive and drive sprockets.

5. The circumferential register adjusting assembly of claim 2 wherein said coupler is connected to said outer bushing by a roller bearing having a gimbal mount.

6. The circumferential register adjusting assembly of claim 2 wherein said second end of said lever is fork-shaped.

7. The circumferential register adjusting assembly of claim 1 wherein said means to effect rotation of said outer bushing includes placing said helically splined drive wheel formed on said outer bushing in meshing engagement with a helically splined gear drive for a printing press.

* * * * *